219-121 SR
9/3/85 OR 4,539,461

United States Patent [19]

Benedict et al.

[11] Patent Number: 4,539,461

[45] Date of Patent: Sep. 3, 1985

[54] METHOD AND APPARATUS FOR LASER GEAR HARDENING

[75] Inventors: Gary F. Benedict, Gilbert; Jim Eskildsen, Mesa, both of Ariz.

[73] Assignee: The Garrett Corporation, Los Angeles, Calif.

[21] Appl. No.: 563,894

[22] Filed: Dec. 21, 1983

[51] Int. Cl.[3] ..... B23K 27/00

[52] U.S. Cl. ..... 219/121 L; 219/121 LW; 219/121 LQ; 219/121 LM; 219/121 FS; 148/147

[58] Field of Search ..... 219/121 LM, 121 L, 121 FS, 219/121 LP, 121 LQ, 121 LR, 121 LW, 121 LY; 148/146, 147

[56] References Cited

U.S. PATENT DOCUMENTS

| | | | |
|---|---|---|---|
| 2,494,440 | 1/1950 | Haynes | 250/233 |
| 3,303,739 | 2/1967 | Chitayat | 350/6.2 |
| 3,592,702 | 7/1971 | Dehn | 148/147 X |
| 3,813,146 | 5/1974 | Burch et al. | 350/285 |
| 4,017,708 | 4/1977 | Engel et al. | 219/121 LF |
| 4,026,732 | 5/1977 | Dammel et al. | 148/147 X |
| 4,125,755 | 11/1978 | Diamquist | 219/121 LW |
| 4,250,372 | 2/1981 | Tani | 219/121 LE |
| 4,250,374 | 2/1981 | Tani | 219/121 LE |

OTHER PUBLICATIONS

U.S. patent application Ser. No. 509,530, filed 6/29/83, assigned to the assignee of the present application.

*Primary Examiner*—C. L. Albritton
*Attorney, Agent, or Firm*—Leslie S. Miller; Albert J. Miller

[57] ABSTRACT

Apparatus and method for laser hardening flank and root areas of gears are disclosed which utilize a non-linear scanning technique to produce a laser light bar which may be traversed over the flank and root areas of the gear to produce uniform case depth while preventing back-tempering by directing coolant flow on to gear tooth flanks opposite those currently being hardened.

28 Claims, 9 Drawing Figures

METHOD AND APPARATUS FOR LASER GEAR HARDENING

BACKGROUND OF THE INVENTION

High quality gears such as spur gears for aerospace applications are required to have hardened gear tooth surfaces to minimize wear, with the interior portion of the gear tooth remaining unhardened to prevent the gear from being brittle, shock-susceptible, and subject to breakage. Typically, the industrial process for manufacture of high quality gears requires either case carburizing and hardening, or induction hardening, of the gear teeth to a specified contour, case depth, and hardness.

Carburizing, which introduces carbon into the surface layer of a low-carbon steel by heating the gear in a furnace while it is in contact with a carbonaceous material to diffuse a portion of the carbon into the steel from the surface, converts the outer layer of the gear into high-carbon steel. The gear may then be removed from the furnace, allowed to cool, and heat-treated by being brought to a high temperature above the transformation point and quickly quenched, transforming the high-carbon surface layer into a hard case containing martensite, while leaving the low-carbon core tough and shock-resistant. Quenching involves rapidly cooling the heated surfaces either conventionally by a gas or a liquid, or by the heat sink effect of the gear's mass (not possible where the gear is heated in a furnace).

Carburizing requires selective masking of the gear, as well as subsequent chemical mask removal, to prevent surface portions of the gear which must remain non-hardened from being hardened in the carburizing process. The quenching step also produces distortion in the part, which will then invariably require a final grinding operation to correct the distortion, particularly in those gears destined for use in aerospace applications and which are required to be of extremely high quality and have critical tolerances.

Quenching dies may be used to minimize distortion during the quenching operation by placing the heated gear into a quenching die fitting the part perfectly. The quenching operation is then performed, and the part may be removed from the quenching die.

It may be appreciated that the carburizing method of hardening gears is both energy and labor intensive, and is therefore quite expensive. In addition, carburizing is quite time-consuming and requires a large amount of equipment, including a furnace, quenching dies which must be custom made for each gear being manufactured, masking equipment, and regrinding equipment.

One alternative to carburizing is induction hardening, where the gear to be hardened is placed inside a coil through which a rapidly alternating current is flowing. Heat is rapidly generated within localized portions of the gear by electromagnetic induction, with the depth of the case being controlled by the frequency of the current in the coil. The gear is then quenched, and induction hardening thus also presents the problem of distortion in the gear which may subsequently require final regrinding operations. As such, induction hardening is also expensive and time-consuming.

Industrial lasers have shown promise in selective rapid heating of surfaces to be hardened. The surface to be heated by a laser beam is generally prepared by applying an absorptive coating which aids in energy transfer from the laser beam into heat energy within the part.

One advantage of using a laser to quickly heat a surface is that conventional quenching by a gas or a liquid is unnecessary since only a shallow surface area of the part is heated. The part will, therefore, actually self-quench, due to the extremely high heat differential between the shallow surface area heated by the laser and the bulk of the part being processed.

Attempts have been made in the past to use industrial lasers for surface heat treatment of parts such as gears, and two such attempts are described in U.S. Pat. Nos. 4,250,372 and 4,250,374, both to Tani. The '374 patent describes the technique of gear hardening using a single beam, and '372 patent describes a technique using two or more beams to obtain more even heating of the gear tooth areas to be hardened.

These patents are both largely impractical for several reasons. First, using the techniques taught in the Tani patents, it is virtually impossible to get an even case depth in the V-shaped area including the flank or side of one gear tooth, the flank of a second adjacent gear tooth, and the root area between the two gear teeth. Laser beams do not have uniform energy density except where they are focused to pinpoint precision, and the more widely focused laser beams of the Tani patents have "hot spots" in the beams resulting in unpredictable and non-uniform heating of the gear surface. Even by using sophisticated lens technology to vary the energy density of the laser beam or beams used, the case depth will not be of sufficient uniformity to meet the specifications for aerospace components. Another problem encountered in using the techniques taught by the Tani patents is that the edges of the gears are frequently burned or melted away to some degree, making the repeatability of any type of quality standard extremely difficult.

Another problem present in the art is back-temper, in which a surface already hardened is reheated and softened by the hardening process of a second surface, in this case an adjacent gear tooth or V-shaped area. Since the Tani patents harden one flank of the gear tooth in one operation, and the opposite flank of a gear tooth in a second operation, sufficient heat is generated in the gear tooth when the second flank is hardened to substantially diminish the hardness in a portion of the first flank in all but very coarse gears. Thus, it may be appreciated that the Tani patents do not present a viable alternative to carburizing and hardening of gears for aerospace or other critical applications.

A more successful technique is taught by U.S. patent application Ser. No. 509,530, filed June 29, 1983 by Benedict and assigned to the assignee of the present application, which application is hereby incorporated herein by reference. The Benedict application splits a laser beam into two identical beams which are focused and directed onto opposite working surfaces of a workpiece such as a gear tooth to simultaneously harden both working surfaces, thereby preventing back-temper. This technique is highly successful for hardening of teeth in lightly loaded gears running in one or both directions, but its shortfall is that the root area between adjacent gear teeth is not hardened. While the root area of a gear is not needed as a wear surface, it is critical in highly loaded gears since it will, if hardened, prevent gear teeth from bending (bending deflection) under heavy load since the hardening of the root area causes the teeth of the gear to be stiffened up while leaving the interior surface of the gear softer for shock-resistance. It may, therefore, be appreciated that a technique for hardening the entire V-shaped groove between two adjacent gear teeth without causing back-temper in surfaces previously hardened must be achieved to make viable laser gear hardening of heavily loaded, high quality gears.

SUMMARY OF THE INVENTION

The present invention utilizes a line-shaped beam created by scanning a focused laser beam at high speed to produce a bar of light. This technique not only eliminates hot spots from appearing in the laser beam directed on the surface to be hardened, but also allows the energy density of the bar of light to be varied from a maximum value at the center of a gear tooth to a minimum value at the edge of the gear tooth, thus preventing melting or burning of the edges of the gear tooth.

The bar of light is directed onto the gear in an orientation parallel to the axis of the gear, with the gear being moved in both a rotary direction and two linear directions to traverse the bar of light from one gear tip down the flank of that gear tip into the root area and up the flank to the tip of the adjacent gear tooth. By utilizing both rotary motion and linear motion in two directions, the bar of laser light is kept as close to orthogonal as possible to the surface being hardened to maximize energy transfer from the laser light bar into the surface of the gear. Additionally, focus of the laser light bar on the gear surface is precisely maintained.

It may therefore be appreciated that by varying the scanning rate in the laser light bar and by varying the traverse rate of the V-shaped valley, a substantially uniform case depth throughtout the V-shaped area between two adjacent teeth is achieved. Due to the character of the laser hardening operation, the V-shaped hardened area will self-quench.

Back-tempering of the flank of the gear tooth opposite the flank being hardened is prevented by utilizing liquid nitrogen cooling jets directed at the gear tooth flanks opposite those flanks being hardened in the operation, with one liquid nitrogen jet being directed at the back side of each of the two teeth forming the V-shaped area.

This technique has a number of striking advantages over the art discussed above. First and foremost, an almost perfectly uniform case depth throughout the V-shaped area between two adjacent gear teeth is created, making the present invention absolutely unique in laser gear hardening technology. The operation is absolutely repeatable, and adaptable for mass production. By varying the scan rate used to create the laser light bar, burning of edges of the gears is eliminated. Finally, by using liquid nitrogen cooling, back-temper is completely eliminated, even from smaller gears.

Since only the surface to be hardened is heated in a laser hardening operation, the large amount of energy formerly required in the carburizing operation is simply not required. Also, since only the surface to be hardened is heated, there is virtually no distortion present in the laser hardening process, thereby eliminating the need for regrinding to correct distortion.

Of course, the process utilizing laser hardening is extremely quick, and may be performed in a single operation thereby reducing the amount of time and labor required. As such, costs of manufacturing high quality gears may be substantially reduced. In addition, the gears produced are suitable for operation in heavily loaded applications since the entire V-shaped area between gear teeth including the root area is uniformly hardened.

DESCRIPTION OF THE DRAWINGS

These and other advantages of the present invention area best illustrated through reference to the drawings, in which.

DETAILED DESCRIPTION OF THE PREFERRED EMBODIMENT

Figure 1:
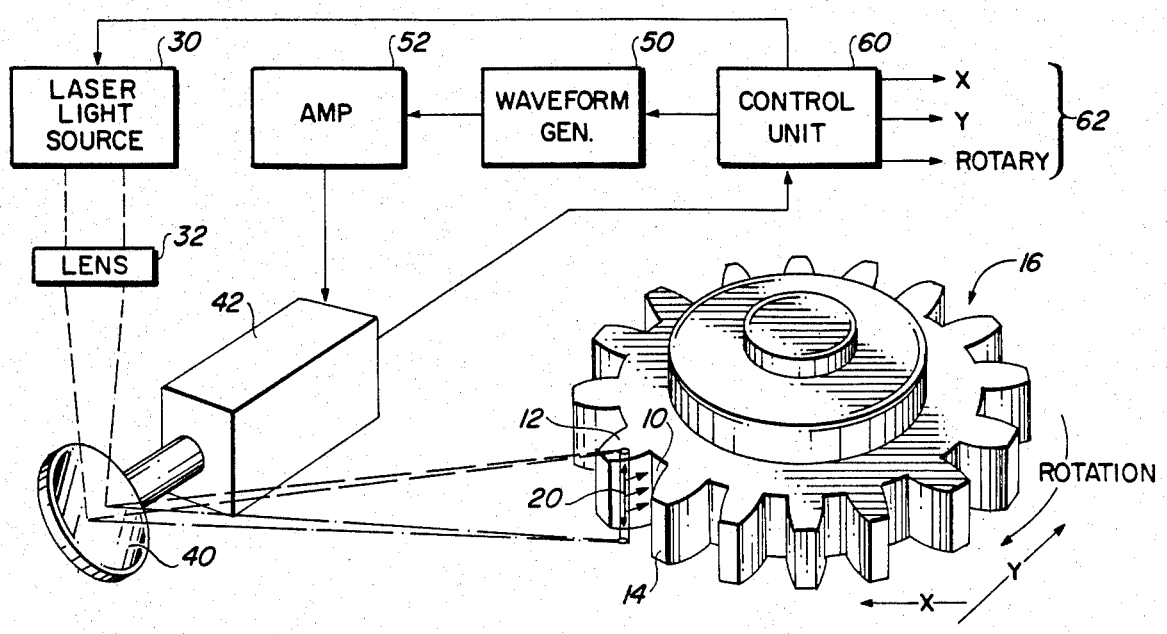
FIG. 1 shows the present invention including the apparatus utilized to produce the laser light bar, as well as a schematic depiction of translational motion of the gear in the laser light beam.

The present invention utilizes the technique of rapidly scanning a focused laser beam across the width of a V-shaped area 10 between a first tooth 12 and a second tooth 14 of a gear 16 to create a laser light bar 20, as shown in FIG. 1. The laser light is supplied from a laser light source 30, and travels through a focusing lens 32, which is typically a standard convex focusing lens in order to create a pinpoint laser light beam. The laser light will then be reflected off a scanning mirror 40 which is rotatably driven in an oscillatory manner by a galvonometer 42. By causing the scanning mirror 40 to oscillate rapidly, typically at 30–60 Hertz, the galvonometer 42 causes the laser light beam to be scanned rapidly along the width of the V-shaped area 10 of the gear 16. Although the focusing lens 32 is illustrated in FIG. 1 in a position before the scanning mirror 40, it should be noted that it could also be placed in the laser light path after the scanning mirror 40.

The gear 16 is positioned so that the portion of the V-shaped area 10 onto which the laser light bar 20 is projected is a preset focal distance from the scanning mirror 40, to allow the focusing lens 32 to focus the laser light from the laser light source 30 onto the surface of the gear 16. One of the unique principles of the present invention is that this distance between the scanning mirror 40 and the portion of the V-shaped area 10 onto which the laser light bar 20 is projected remains a constant in order to keep the laser light bar 20 precisely focused.

The signal used to drive the galvonometer 42 and the scanning mirror 40 is supplied by an arbitrary waveform generator 50 through a galvonometer amp 52. It will be recognized that in heating the surface of the gear, it requires somewhat more energy to heat a location on the interior portion of the V-shaped area 10 then is required to heat a location at the edge of the V-shaped area 10. Therefore, the scanning rate across the surface of the V-shaped area 10 must be nonlinear to produce uniform heating across the width of the V-shaped area 10 being heated by the laser light bar 20.

Figure 5:
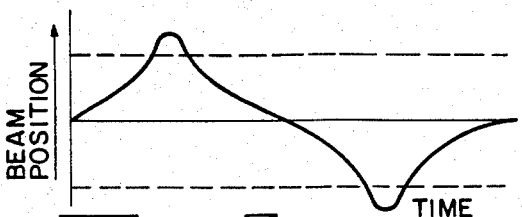
FIG. 5 is a graph showning the scanning pattern produced by the apparatus shown in FIG. 1 to ensure uniform case depth along the area heated by the laser light bar.

The arbitrary waveform generator 50 will therefore supply a signal similar to that illustrated in FIG. 5 as opposed to a straight zigzag waveform. The dotted lines in FIG. 5 represent the beam position at the edges of the V-shaped area 10, and the area between the dotted lines represents the width of the V-shaped area 10. As FIG. 5 indicates, the beam velocity increases as the location of the beam approaches the edges of the V-shaped area 10. There is a certain amount of overscan of the V-shaped area 10, as indicated by the plot in FIG. 5. The overscan is necessary since the galvonometer 42 is not ideal and therefore reacts in an inertially limited manner rather than an ideal manner. Without the overscan, it would be virtually impossible to avoid burning or melting the edges of the V-shaped area 10.

Returning to FIG. 1, a control unit 60 may be utilized to coordinate the operation of the arbitrary waveform generator 50 and the initiating of a laser light beam from the laser light source 30. The control unit 60 also preferably monitors the actual position of the galvonometer 42 (and hence the scanning mirror 40), utilizing the feedback signal to ensure that the desired uniform heating effect is caused by the laser light bar 20 on the V-shaped area 10.

The control unit 60 has another important function in addition to ensuring that laser light bar 20 presents the desired heating characteristics. That function is coordinating the movement of the gear 16 with respect to the laser light bar 20. Rather than traversing the laser light bar 20 across the V-shaped area 10 of the gear 16, the present invention moves the gear 16 in the path of the laser light bar 20 to heat the surface of the V-shaped area 10.

Before progressing into an explanation of how the control unit 60 moves the gear 16, a brief discussion of the factors controlling absorption of heat energy from the laser light bar 20 into the surface of the V-shaped area 10 are in order. The first of these factors is the coefficient of absorbtion, that is, how much of the energy from the laser light bar 20 is absorped by the surface of the V-shaped area 10 rather than being reflected off of the gear surface. In order to maximize the amount of energy absorbed into the surface of the gear 16, it is necessary to coat the surface of the gear which is to be heat treated with an absorptive coating. Although this coating may be flat black paint, it has been found that a charcoal powder suspended in an epoxy binder is a superior coating. Typically, the absorptive coating is sprayed on in a uniform coat with the gear spinning, the spraying operation occurring for a specified time through a predetermined window area to insure overall repeatability of the operation.

The other factor in ensuring that as great a portion as possible of the heat energy in the laser light bar 20 is absorbed by the surface of the V-shaped area 10 is to make the intersection of the laser light bar 20 from the scanning mirror to that portion of the V-shaped area onto which the laser, light bar 20 is directed as close as possible to perpendicular. In order to keep this intersection reasonably close to perpendicular, it is necessary to move the gear 16 in one linear direction in addition to turning the gear 16 in a rotary direction. Movement of the gear 16 in a second linear direction is necessary to maintain the focus of the laser light bar 20 on the surface of the gear 16.

The movement of the gear 16 in the two linear directions (both in a plane orthogonal to the axis of the gear) and in the rotary direction are coordinated by the control unit 60, which provides an X output, a Y output, and a rotary output, these three outputs being collectively known as the gear translational outputs 62. It will be appreciated that by controlling the three gear translational outputs 62, the laser light bar 20 will traverse the area of the V-shaped area 10 to harden the entire surface of the V-shaped area 10. By utilizing the control unit to vary the rate at which the laser light bar 20 traverses the surface of the V-shaped area 10 as required, a uniform case depth throughout the area of the V-shaped area 10 may be achieved.

Figure 4:
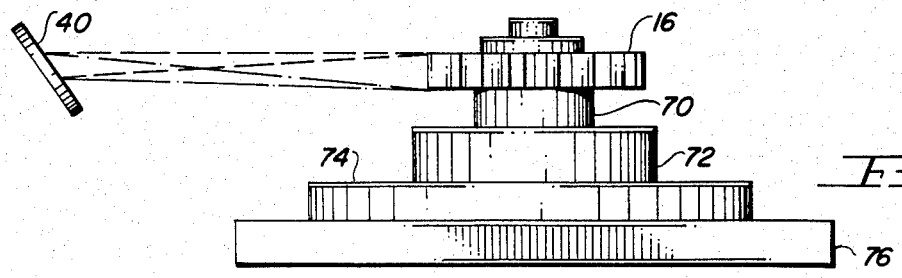
FIG. 4 is a side view of the apparatus shown in FIG. 3 and used to produce the traverse motion of the gear in the laser light bar.

In FIG. 4, the apparatus used to cause the desired movement of the gear 16 is illustrated. The gear 16 is mounted on and moves with a gear support 70, and is secured through the use of a key or other means of securring the gear 16 to the gear support 70). The gear support 70 is mounted on an indexing rotary 72, which moves only to advance the gear from one V-shaped area 10 to the next. During the actual hardening operation, the indexing rotary 72 does not move independently, but rather moves with a positioning rotary 74 on which the indexing rotary 72 rides. The positioning rotary will, therefore, turn the gear support 70 and the gear 16 to create the rotary component of the gear translational output 62 needed to traverse the V-shaped area 10 with the laser light bar 20. The positioning rotary 74 is mounted on a base 76, and moves in the two linear directions (FIG. 1) also needed to traverse the V-shaped area 10 in the laser light bar 20.

Figure 2:
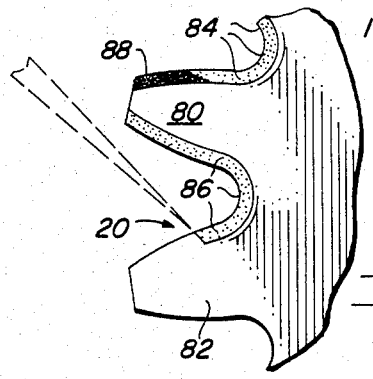
FIG. 2 demonstrates the need for cooling apparatus to prevent back-temper in gear flank areas previously hardened.

While the apparatus and methods hereinabove described will satisfactorily harden the V-shaped areas 10 of a gear 16, if the gear 16 is of a smaller size or has a fine pitch the problem of back-temperating may arise. This problem is illustrated in FIG. 2, which shows a first tooth 80 and a second tooth 82 adjacent to the first tooth 80. The first tooth 80 has had one side hardened in a previous step which creates an area previously hardened 84 which includes the one side of the first tooth 80. If the area being hardened 86 includes the other side of the first tooth 80, and if the first tooth 80 is not thick enough, a back-tempered area 88 on the side of the first tooth 80 in the area previously hardened 84 will be created which is unacceptably soft.

Figure 3:
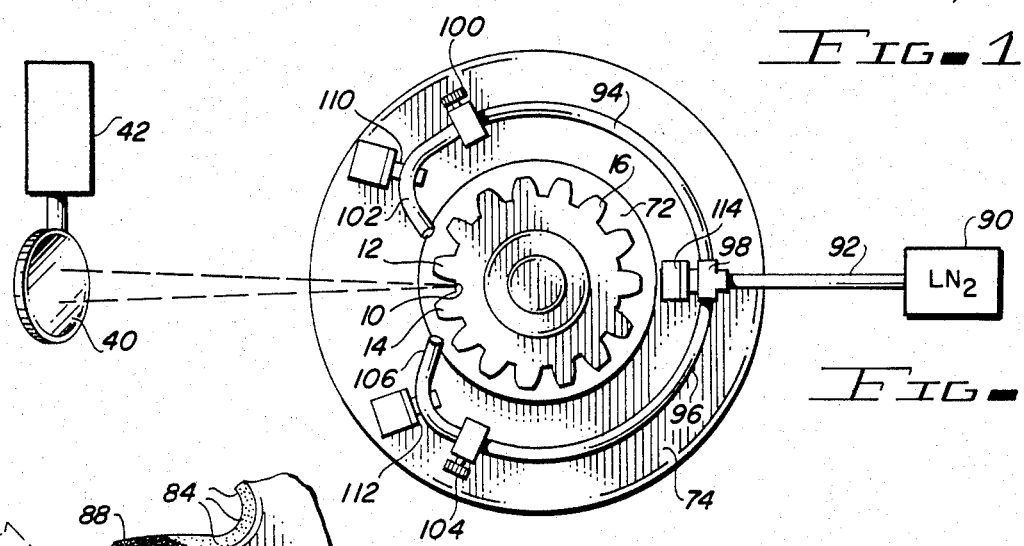
FIG. 3 shows the cooling apparatus utilized to solve the back-temper problem illustrated in FIG. 2, as well as the apparatus used to produce the traversing motion of the gear in the laser light bar produced by the apparatus of FIG. 1.

It may therefore be appreciated that when hardening smaller gears or gears having a fine pitch, it is necessary to prevent back-tempering such as that illustrated in FIG. 2. FIG. 3 illustrates the present invention further including apparatus to eliminate back-tempering of the teeth of the gear 16. Liquid nitrogen supplied from a liquid nitrogen tank 90 through tubing 92 is divided into two supply tubes 94, 96 by a tee fitting 98. The supply tube 94 goes through a bleed valve 100 which meters the amount of liquid nitrogen flowing therethrough to a nozzle 102 which is directed onto the side of the first tooth 12 not in the V-shaped area 10 currently being hardened.

Likewise, the supply tube 96 goes through a second bleed valve 104 to a nozzle 106, which is directed at the side of the second tooth 14 not included in the V-shaped area 10 being currently hardened. The nozzles 102, 106 are fixedly mounted to the positioning rotary by nozzle supports 110, 112 respectively. The tee fitting 98 may be supported by a tubing support 114, also mounted onto the positioning rotary 74.. While liquid nitrogen is used in the preferred embodiment since it is relatively inexpensive, other coolants could be used with acceptable results.

It may therefore be appreciated that when the gear 16 is moved in either a rotary manner by the postioning rotary 74; or in one of the two linear directions by relative motion of the positioning rotary 74 with respect to the base 76, the nozzle supports 110, 112 will remain directed at the sides of the first tooth 12 and the second tooth 14 not in the V-shaped area 10 currently being hardened. Thermocouples (not shown) may be used to make temperature measurements in the nozzles 102, 106, or in the portion of the supply tubes 94, 96 immediately before the nozzles 102, 106, respectively. By adjusting the bleed valves 100, 104 to predetermine temperature settings as indicated by the thermocouples, repeatability of the operation will not be affected by the cooling flow of liquid nitrogen onto the gear 16. However, the occurrence of back-temper in the gear 16 will be completely eliminated.

Figure 6:
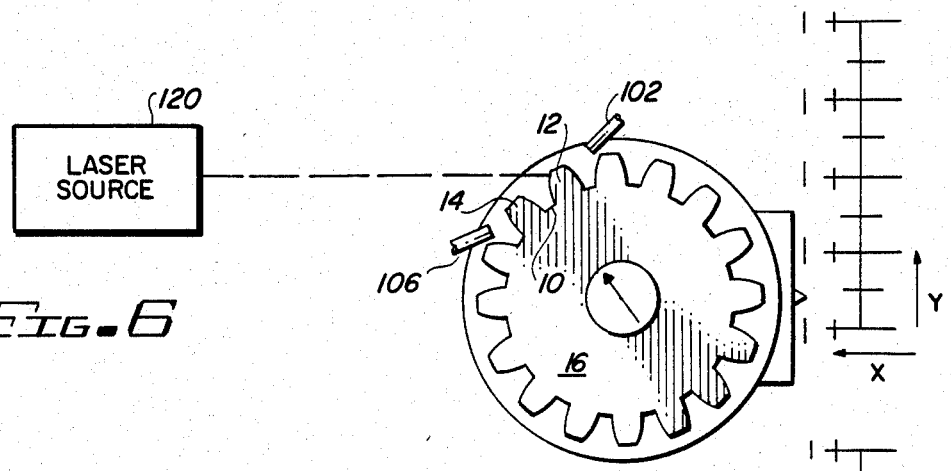
FIG. 6 shows the rotational and translational position of a gear at the beginning of a hardening operation in a V-shaped area between two adjacent teeth.
Figure 7:
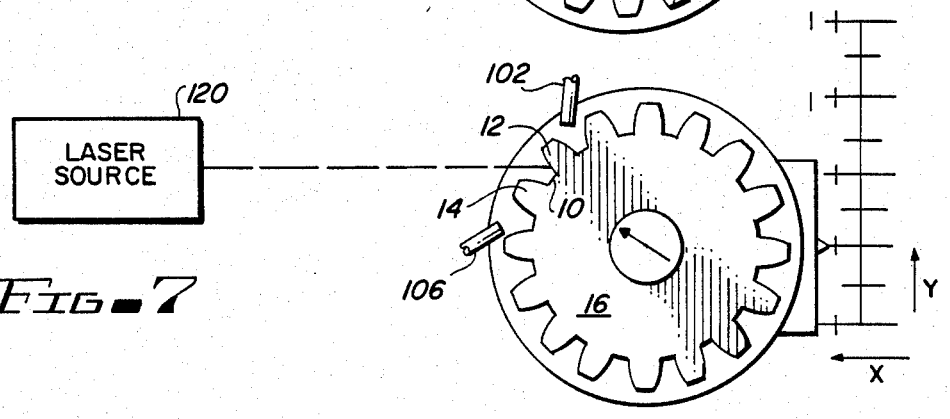
FIG. 7 shows the rotational and translational position of the gear of FIG. 6 with the laser light bar moving down the flank of the first gear tooth in the V-shaped area.

FIGS. 6–9 schematically illustrate an exemplary hardening of the V-shaped area 10 between the first tooth 12 and second tooth 14 of the gear 16 at various stages as the gear 16 is rotated and moved in the two linear directions. In FIG. 6, the hardening operation has just begun with the laser light bar 20 being directed onto the top of the V-shaped area 10 of the flank of the first tooth 12. As the laser light bar 20 traverses the V-shaped area to the position indicated in FIG. 7, the gear 16 is rotated counterclockwise and is moved in the Y direction to maintain the approximately perpendicular angle and in the X direction to maintain the constant distance between the laser light bar source 120 (representing the apparatus depicted in FIGS. 1 and 3–4) and the portion of the V-shaped area 10 currently being heated by the laser light bar 20.

Figure 8:
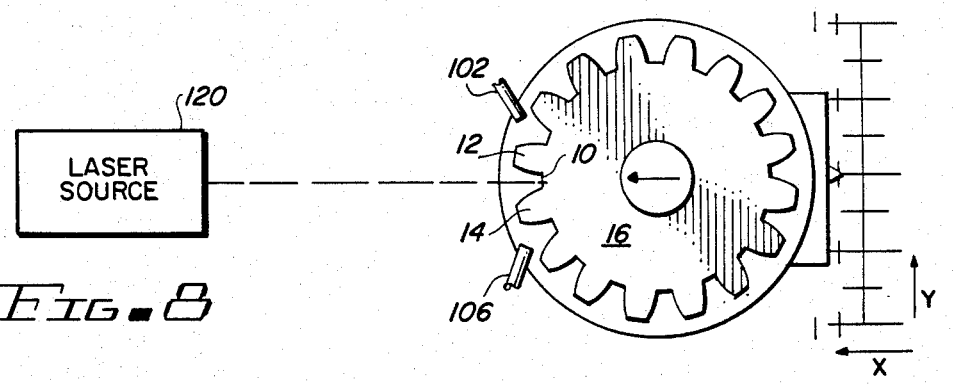
FIG. 8 shows the rotational and translational position of the gear of FIG. 6 with the laser light bar at the root of the V-shaped area between the two adjacent teeth.
Figure 9:
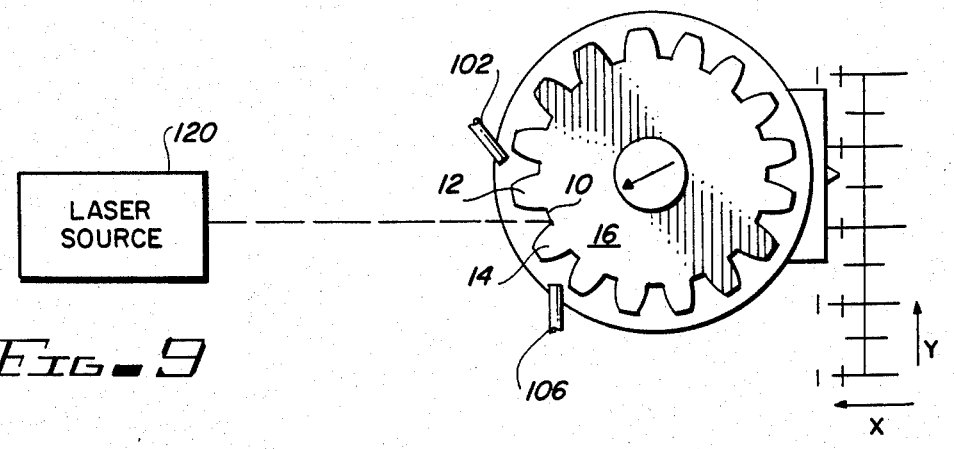
FIG. 9 shows the rotational and translational position of the gear of FIG. 6 as the laser light bar moves up the flank of the second tooth in the V-shaped area.

Moving to FIG. 8, the root area of the V-shaped area 10 is being heated by the laser light bar 20, and the gear has rotated further counterclockwise as well as having moved in the two linear directions to maintain the constant distance between the laser light bar source 120 and the root area of the V-shaped area 10. Finally, in FIG. 9, the laser light bar 20 has begun to traverse up the flank of the second tooth 14 to finish the heating and hardening of the V-shaped area 10, and the gear 16 has moved further in both the rotary and linear directions to maintain both the constant distance between the laser light bar source 120 and the V-shaped area 10 being hardened by the laser light bar 20, as well as the closest approximation possible to perpendicularity between the laser beam and the surface of the V-shaped area 10 currently being heated by the laser light bar 20.

Thus, it may be seen that by creating a laser light bar 20 from a non-linear scanning of a focused laser light beam, a uniformly heated line which is the intersection between the laser light bar 20 and the V-shaped area 10 will be created. By traversing the laser light bar 20 across the surface of the V-shaped area 10 while maintaining constant focal distance and moving the gear to maintain as great a degree of perpendicularity as possible between the laser light beam and the surface of the V-shaped area 10 on which the laser light bar 20 is focused, uniform heating and therefore hardening of the surface of the V-shaped area 10 will result. The laser light bar 20 is traversed across the V-shaped area 10 at a non-linear speed which is highest adjacent the edge of the gear teeth and lowest in the root area of the gear, which requires more heat energy to produce the same degree of heating therein.

It has been determined that a very uniform case depth in the V-shaped area between adjacent gear teeth may be achieved by utilizing the apparatus and principles of the present invention. The operation has indicated excellent repeatability, and has resulted in complete elimination of burning or melting of the edges of gear teeth. The present invention therefore makes practical and relatively inexpensive laser gear hardening even of heavily loaded gears requiring a high degree of precision, since there is virtually no distortion in the gear. The present invention is also suitable for automatic operation, resulting in higher productivity and lower energy and labor costs, resulting in improved quality at a lower overall cost.

We claim:

1. A method of hardening the flank of a first gear tooth, the flank of a second gear tooth, and the root area between said first and second gear tooth, comprising:
   - supplying a high power laser light beam;
   - focusing said high power laser light beam at a predetermined focal length on the gear to establish a focused laser light beam;
   - scanning said focused laser light beam across the width of said gear to create a laser light bar;
   - rotating said gear about its axis to traverse said laser light bar down said flank of said first gear tooth, across said root area between said first and second tooth, and up said flank of said second tooth;
   - simultaneously moving said gear in a first direction to maintain as close as possible an approximation to perpendicularlity between said focused laser light beam and the surface of said gear on which said laser light bar is directed; and
   - simultaneously moving said gear in a second direction orthogonal to said first direction to maintain said predetermined focal length.

2. A method as defined in claim 1, wherein said focusing step is performed by directing said high power laser light beam through a convex focusing lens.

3. A method as defined in claim 1, wherein said scanning step comprises:
   - interposing a mirror in the path of said high power laser light beam and directing the reflected laser light beam onto said gear; and
   - oscillating said mirror to direct said reflected laser light beam back and forth across the width of said gear.

4. A method as defined in claim 3, wherein said oscillating step is performed by a galvonometer mechanically driving said mirror, said galvanometer being driven by a random waveform generator through a galvonometer amplifier.

5. A method as defined in claim 1, wherein the scanning pattern takes said focused laser light beam beyond the edges of said gear before reversing to avoid burning or melting of the edges of said gear.

6. A method as defined in claim 1, wherein the scan rate is between 30 and 60 Hz.

7. A method as defined in claim 1, wherein the scanning velocity across the width of said gear is nonlinear to produce a uniform heating effect across the width of said gear, with the velocity being greater when said focused laser light beam is near the edges of said gear than when it is in the middle of said gear.

8. A method as defined in claim 1, wherein the traverse rate down said flank of said first gear tooth, across said root area between said first and second teeth, and up said flank of said second tooth is varied in a nonlinear manner to cause the formation of a uniform case depth in the hardened areas of said gear.

9. A method as defined in claim 1, wherein said first direction is perpendicular to both said axis of said gear and said focused laser light beam as it is directed at the surface of said gear.

10. A method as defined in claim 1, wherein said second direction is parallel to said focused laser light beam as it is directed at the surface of said gear.

11. A method as defined in claim 1, further comprising:

the preliminary step of coating the surfaces of said gear to be hardened with an absorptive coating to maximize energy transfer from said focused laser light beam to said surfaces of said gear.

12. A method as defined in claim 11, wherein said absorptive coating is charcoal powder suspended in an epoxy binder.

13. A method as defined in claim 1, additionally comprising:

directing a cooling fluid at the flanks of said first and second gear teeth opposite those flanks presently being hardened to prevent back-temper therein.

14. A method as defined in claim 13, wherein said cooling fluid is liquid nitrogen.

15. A method of hardening a flank-root-flank area of a gear, comprising:

scanning a focused, high power laser light beam across the surface of said gear in a direction parallel to the axis of said gear to produce a laser light bar having a predetermined focal length;

traversing said flank-root-flank area of said gear with said laser light bar;

maintaining the surface of said gear on which said laser light bar is directed in as close as possible to an orthogonal direction to said high power laser light beam while said flank-root-flank area of said gear is traversed; and maintaining said predetermined focal distance while said flank-root-flank area is traversed.

16. A method as defined in claim 15, further comprising:

varying the scanning velocity in said scanning step to produce a uniform heating effect of said laser light bar across said surface of said gear.

17. A method as defined in claim 15, further comprising:

varying the traversing velocity in said traversing step to produce a uniform case depth in said flank-root-flank area.

18. A method of hardening a V-shaped area of a gear including the flank of a first gear tooth, the flank of an adjacent gear tooth, and the root area between said first and second gear teeth, comprising:

supplying a high power focused laser light beam having a predetermined focal length;

scanning at a nonlinear rate the width of said V-shaped area with said high power focused laser light beam to produce a narrow bar-shaped uniform heating pattern across the width of said V-shaped area;

traversing at a nonlinear rate said V-shaped area with the scanned high power focused laser light beam to produce the desired hardening characteristics throughout said V-shaped area.

19. A device for producing uniform case depth hardness in a flank-root-flank area of a gear utilizing a high power laser light beam, comprising:

a focusing lens for establishing a predetermined focal length between the source of said high power laser light beam and the area of said gear on which said high power laser light beam is directed;

a scanning mirror in the path of said high power laser light beam for establishing a bar-shaped laser light pattern on said gear in a direction parallel to the axis of said gear;

means for traversing said flank-root-flank area of said gear with said bar-shaped laser light pattern to harden said flank-root-flank area of said gear.

20. A device as defined in claim 19, further comprising:

a galvonometer for mechanically driving said scanning mirror in an oscillatory manner.

21. A device as defined in claim 20, wherein said galvonometer drives said mirror at a non-linear velocity to accelerate the speed of said high power laser light beam near the edges of said gear to avoid burning or melting of said edges of said gear.

22. A device as defined in claim 19, wherein said traversing means comprises:

a positioning rotary to rotate said gear about its axis to move said gear in said-bar shaped laser light pattern.

23. A device as defined in claim 22, wherein said traversing means additionally comprises:

means for moving said gear in a linear first direction to maintain as close as possible an approximation to perpendicularity between said high power laser light beam and the area of said gear on which said high power laser light beam is directed.

24. A device as defined in claim 22, wherein said traversing means additionally comprises:

means for moving said gear in a linear second direction to maintain said predetermined focal length.

25. A device as defined in claim 19, additionally comprising:

an indexing rotary to move said gear to the next flank-root-flank area to be hardened after said flank-root-flank area is hardened.

26. A device as defined in claim 19, further comprising:

a cooling fluid source;

means for directing said cooling fluid onto the flanks of said first and second gear teeth opposite those flanks presently being hardened to prevent back-temper therein.

27. A device as defined in claim 26, wherein said cooling fluid is liquid nitrogen.

28. A device for hardening a V-shaped area of a gear including the flank of a first gear tooth, the flank of a second gear tooth, and the root area between said first and second gear teeth, comprising:

a high power laser light source;

means for focusing laser light from said high power laser light source into a collimated laser light beam having a preset focal length;

means for scanning said laser light beam onto said gear to produce a laser light bar across the width of said gear;

means for traversing said V-shaped area with said laser light beam to produce a hardened surface in said V-shaped area, said traversing means maintaining said preset focal length and keeping the portion of said V-shaped area on which said laser light bar is directed approximately orthogonal to said scanned laser light beam.

* * * * *